US009809971B2

(12) United States Patent
Roberts et al.

(10) Patent No.: US 9,809,971 B2
(45) Date of Patent: Nov. 7, 2017

(54) ARCHITECTURAL BUILDING BLOCK

(71) Applicants: Peter Andrew Roberts, Alfred Station, NY (US); Wanrui He, Alfred, NY (US); Nolan Andrew Jessop, Churchville, NY (US); Sanket T. Patel, Auburn, NY (US); Alexander Karl Wessner, Pineville, PA (US); Nicholas Stephen Roberts, Holland Patent, NY (US); Patrick Richard Byrne, Hamburg, NY (US); Pavel Boyuk, Rochester, NY (US); Martin Monk, Falmouth, MA (US)

(72) Inventors: Peter Andrew Roberts, Alfred Station, NY (US); Wanrui He, Alfred, NY (US); Nolan Andrew Jessop, Churchville, NY (US); Sanket T. Patel, Auburn, NY (US); Alexander Karl Wessner, Pineville, PA (US); Nicholas Stephen Roberts, Holland Patent, NY (US); Patrick Richard Byrne, Hamburg, NY (US); Pavel Boyuk, Rochester, NY (US); Martin Monk, Falmouth, MA (US)

(73) Assignee: Spherical Block LLC, Alfred Station, NY (US)

( * ) Notice: Subject to any disclaimer, the term of this patent is extended or adjusted under 35 U.S.C. 154(b) by 118 days.

(21) Appl. No.: 15/053,986

(22) Filed: Feb. 25, 2016

(65) Prior Publication Data

US 2017/0247874 A1 Aug. 31, 2017

(51) Int. Cl.
*E04B 1/02* (2006.01)
*E04C 1/00* (2006.01)
(Continued)

(52) U.S. Cl.
CPC ..... *E04B 1/02* (2013.01); *E04B 1/32* (2013.01); *E04B 7/10* (2013.01); *E04C 1/00* (2013.01); *E04B 2001/327* (2013.01)

(58) Field of Classification Search
CPC ..... E04C 1/00; E04C 2201/12; E04C 5/00; E02D 29/025; E02D 29/0241;
(Continued)

(56) References Cited

U.S. PATENT DOCUMENTS 1,242,669 A * 10/1917 Erkens ..... E04B 2/12 52/575
1,417,010 A * 5/1922 Wright ..... E01C 5/00 404/34

(Continued)

*Primary Examiner* — James M Ference
(74) *Attorney, Agent, or Firm* — Tracy Jong Law firm; Tracy P. Jong; Cheng Ning Jong

(57) ABSTRACT

An architectural building block including a generally triangular block having an outer wall, an inner wall disposed in substantially parallel configuration with respect to the outer wall and three side walls, each adjoining the outer wall and the inner wall. One of the side walls includes dual inverse mirror planes and each of the other two of which includes a single inverse mirror plane. At least one the side walls is configured to be positionable so as to mate with a side wall of an abuttingly disposed block, whereby curved structures may be constructed from a plurality of such blocks to form a dihedral angle between each set of two blocks. In one embodiment, the inner wall further includes at least one depression disposed on the inner wall of the block.

15 Claims, 16 Drawing Sheets

(51) Int. Cl.
*E04B 1/32* (2006.01)
*E04B 7/10* (2006.01)

(58) Field of Classification Search
CPC ..... E02D 29/0225; E02D 29/0266; E02D 2200/1678; E04B 2/12; E04B 2/08; E04B 2/16; E04B 2/22; E04B 2001/3294; E04B 2001/327; E04B 2002/0208; E04B 2002/0269; E04B 2002/0204; E04B 2002/0215; E04B 2002/0263; E04B 1/02; E04B 1/32; E04B 7/10
USPC ..... 52/604, 608, 606, 592.6, 609, 605, 575, 52/592.1, 284, 574, 590.2, 591.1, 596, 52/607
See application file for complete search history.

(56) References Cited

U.S. PATENT DOCUMENTS 1,500,808 A * 7/1924 Fuhrmann ..... E04B 2/14 52/504
1,895,801 A * 1/1933 Keller ..... E04F 13/08 52/591.2
1,969,729 A * 8/1934 Damianik ..... E01C 5/00 404/41
2,214,657 A * 9/1940 Brown ..... E04B 2/12 52/378
2,253,234 A * 8/1941 Grice ..... E04B 2/04 12/40
2,392,551 A * 1/1946 Roe ..... E04B 2/08 52/309.17
2,736,072 A * 2/1956 Woods ..... E04B 1/32 52/795.1
3,355,849 A * 12/1967 Hancock ..... E04B 2/22 52/396.08
3,783,571 A * 1/1974 Horvath ..... E04B 2/12 52/575
3,859,769 A * 1/1975 Watkins ..... A63H 33/088 446/125
3,956,862 A * 5/1976 Alexandre, Jr. ..... E04B 2/22 52/286
3,962,842 A * 6/1976 Wilhelm ..... E04B 2/18 52/286
3,996,715 A * 12/1976 Dowse ..... E01C 5/00 52/591.1
4,092,810 A * 6/1978 Sumner ..... E04B 1/3211 52/745.08
4,194,327 A * 3/1980 Simone ..... E04B 1/32 52/86
4,207,715 A * 6/1980 Kitrick ..... E04B 1/19 428/542.2
4,241,550 A * 12/1980 Sumner ..... E04B 1/32 52/81.4
4,593,513 A * 6/1986 Stratton ..... E04B 2/12 404/41
4,736,550 A * 4/1988 Hawranick ..... E04B 2/12 52/574
4,773,790 A * 9/1988 Hagenah ..... E01C 5/06 404/38
4,802,320 A * 2/1989 Forsberg ..... E02D 29/025 52/585.1
5,249,966 A * 10/1993 Hiigli ..... G09B 23/04 434/211
5,329,737 A * 7/1994 Roberts ..... E04B 1/3211 52/245
5,421,135 A * 6/1995 Stevens ..... E04B 2/16 405/284
5,490,363 A * 2/1996 Woolford ..... B28B 7/0097 405/284
5,505,034 A * 4/1996 Dueck ..... E02D 29/025 405/286
5,507,599 A * 4/1996 Anderson ..... E02D 29/02 405/262
5,524,396 A * 6/1996 Lalvani ..... E04B 1/19 52/311.2
5,540,525 A * 7/1996 Miller ..... E02D 29/0225 405/284
5,586,841 A * 12/1996 Anderson ..... B29C 49/2408 405/286
5,704,183 A * 1/1998 Woolford ..... B28B 7/0097 405/284
5,709,062 A * 1/1998 Woolford ..... B28B 7/0097 52/592.6
5,729,943 A * 3/1998 Cambiuzzi ..... E04B 2/46 52/438
5,913,790 A * 6/1999 Dawson ..... E04C 1/395 405/286
5,984,589 A * 11/1999 Ciccarello ..... E02D 29/025 405/262
6,168,353 B1 * 1/2001 Price ..... E02D 29/0208 405/284
6,336,773 B1 * 1/2002 Anderson ..... E02D 29/02 405/262
6,430,886 B1 * 8/2002 Schmitz ..... E04B 2/12 404/41
6,523,317 B1 * 2/2003 Bott ..... E04C 1/395 256/19
6,536,994 B2 * 3/2003 Race ..... E02D 29/0241 403/381
6,543,969 B1 * 4/2003 Adam ..... E02D 29/025 405/262
6,591,569 B2 * 7/2003 Azar ..... E04B 2/16 52/604
6,622,445 B1 * 9/2003 Shillingburg ..... E02D 29/0225 405/284
6,651,401 B2 * 11/2003 Price ..... E02D 29/025 405/262
6,701,687 B1 * 3/2004 Shillingburg ..... E02D 29/0241 405/284
7,096,635 B2 * 8/2006 Price ..... E02D 29/025 405/284
7,168,892 B1 * 1/2007 MacDonald ..... E02D 29/0225 405/284
8,141,315 B1 * 3/2012 Shillingburg ..... E02D 29/025 405/286
8,201,376 B2 * 6/2012 Witcher ..... E04C 1/395 52/565
8,286,402 B2 * 10/2012 Fleishman ..... E04B 2/06 446/109
8,820,024 B1 * 9/2014 Abdullah ..... E04B 2/08 52/561
9,133,619 B1 * 9/2015 Roberts ..... E04C 1/00
2003/0007834 A1 * 1/2003 Bolduc ..... E01C 5/06 404/41
2003/0070384 A1 * 4/2003 Drost ..... E01C 11/229 52/604
2006/0000179 A1 * 1/2006 Albert ..... E04B 2/16 52/606
2006/0021288 A1 * 2/2006 Dueck ..... E02D 29/0241 52/102
2006/0059839 A1 * 3/2006 Azar ..... E04B 2/16 52/606
2007/0094991 A1 * 5/2007 Price ..... E02D 29/025 52/596
2008/0260474 A1 * 10/2008 Koster ..... E04C 1/395 405/284
2009/0249734 A1 * 10/2009 Karau ..... E04C 1/395 52/604
2010/0043335 A1 * 2/2010 O'Connor ..... E04B 2/16 52/592.6
2010/0162649 A1 * 7/2010 Boot ..... E02D 29/025 52/426
2011/0146191 A1 * 6/2011 Farrell ..... G21F 1/04 52/604
2011/0318100 A1 * 12/2011 Rainey ..... E02D 29/025 404/6
2013/0178130 A1 * 7/2013 Balint ..... A63H 33/065 446/120

(56) References Cited

U.S. PATENT DOCUMENTS

| | | | | |
|---|---|---|---|---|
| 2013/0205705 | A1* | 8/2013 | Bilka | E04B 2/44 52/604 |
| 2013/0247503 | A1* | 9/2013 | Yong | E01C 5/00 52/604 |
| 2013/0279979 | A1* | 10/2013 | Pollack | E01C 5/00 404/41 |
| 2013/0312359 | A1* | 11/2013 | Weber | E04B 2/48 52/606 |
| 2015/0152631 | A1* | 6/2015 | Bree | E04B 7/20 52/604 |
| 2015/0167300 | A1* | 6/2015 | Li-Chin | E04B 2/08 52/223.7 |

* cited by examiner

FIG. 1
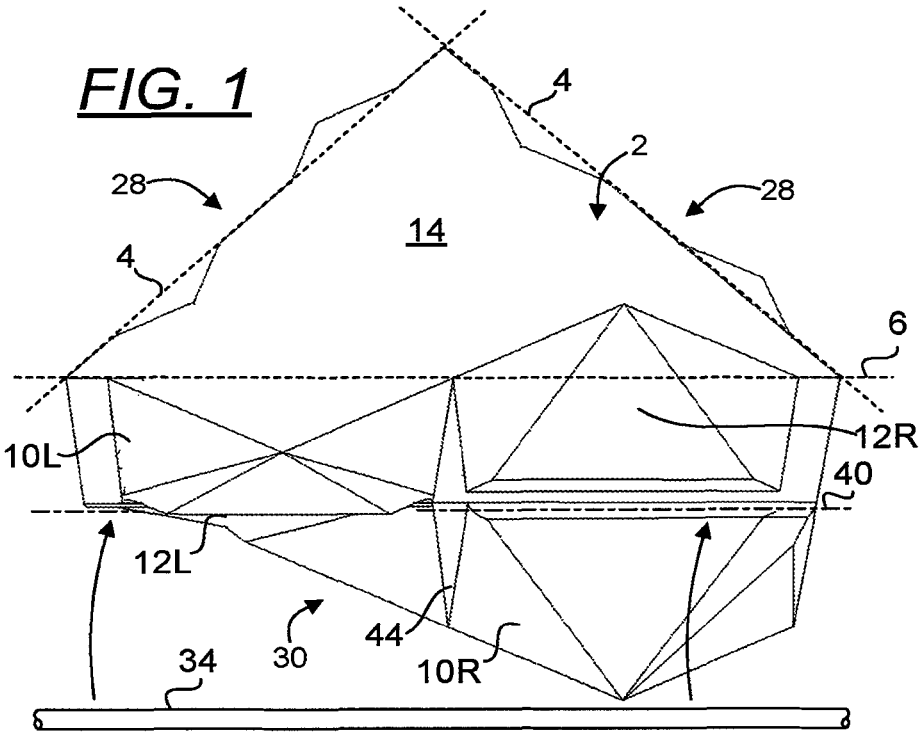
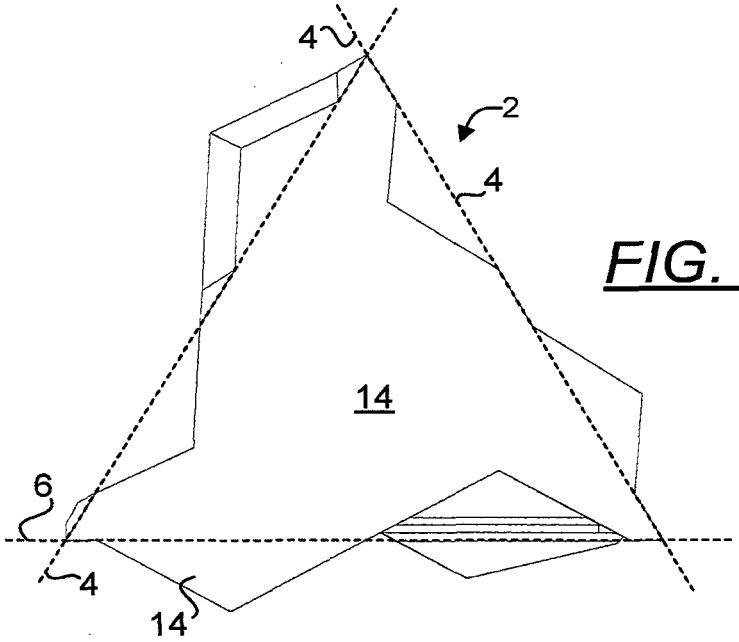
FIG. 2

ARCHITECTURAL BUILDING BLOCK

BACKGROUND OF THE INVENTION

1. The Field of the Invention

The present invention is directed generally to architectural building blocks for constructing spheres or spherical domes. More specifically, the present invention is directed to masonry architectural building blocks for constructing spheres or spherical domes.

2. Background Art

In fabricating structures composed of curvilinear parts, typically forms are required for concrete pouring as conventional blocks are often unsuitable for constructing such parts as conventional masonry blocks are unsuitable due to their shapes and sizes. On-site constructions of structures using forms often involve significant custom architectural and engineering preparation work, which not only increases the construction cost but also the lead time in completing the construction projects. Even if conventional masonry blocks are used to construct curvilinear parts, sufficient skills are required to custom shape some masonry blocks so that they can fit in with other unmodified blocks to approximate the structural shape to be constructed. Conventional blocks used for curvilinear parts include rectangular and triangular blocks, etc. In many occasions, sufficient skills may also be required to adjust the amount of mortar used or the configuration of the gasket between blocks such that curvilinear parts can be constructed. When built without forms or other supporting structures, the use of conventional blocks does not yield uniform, accurate and repeatable curvilinear parts, e.g., cylinders and arches, let alone spheres and spherical domes. It may even be impossible to construct a curvilinear structure using conventional blocks if mortar or gasket had not been used.

U.S. Pat. No. 2,392,551 to Roe (hereinafter Roe) discloses a wall structure having a series of superposed courses of building blocks, matching keyways in certain adjacent blocks in a course and keys in the keyways locking the adjacent blocks together. Each of the keys extends from one course into and fits snugly within an opening in a block of an adjacent course, thereby locking adjacent courses together against horizontal shifting, and tongue and groove connections inclined to the longitudinal axes of the keys and interlocking blocks of adjacent courses whereby the first named keys and the tongue and groove connections lock the courses against vertical as well as horizontal shifting, the tongues of the tongue and groove connections being each integral with a block. Although a means for interlocking adjacently disposed blocks is provided, Roe fails to disclose building blocks useful for building spheres or spherical domes.

U.S. Pat. Pub. No. 2013/0205705 of Bilka (hereinafter Bilka) discloses a masonry article having one or more sidewalls, top and bottom, and first and second ends configured with a horizontal and vertical locking mechanism, wherein top and bottom includes first axis locking mechanism, wherein the top surface is formed with at least one stepped section having a base that begins with a level footing and the bottom opposite surface formed with at least one other stepped section having a base that begins with a level footing to releasably receive one of the top, and wherein first and second ends include contoured receptacles to releasably receive a matching configured link block having opposite male contour surface to form second axis locking mechanism. Similar to Roe, Bilka fails to disclose building blocks useful for building spheres and spherical domes.

Thus, there is a need for blocks useful for constructing spheres and spherical domes that are capable of resisting environmental forces and ones which can be built without using pre-fabricated or in-situ built forms and temporary support structures or scaffolding systems.

SUMMARY OF THE INVENTION

In accordance with the present invention, there is provided an architectural building block including a generally triangular block having an outer wall, an inner wall disposed in substantially parallel configuration with respect to the outer wall and three side walls, each adjoining the outer wall and the inner wall. One of the side walls includes dual inverse mirror planes and each of the other two of which includes a single inverse mirror plane. At least one of the side walls is configured to be positionable so as to mate with a side wall of an abuttingly disposed block, whereby curved structures may be constructed from a plurality of such blocks to form a dihedral angle between each set of two blocks.

In one embodiment, the inner wall further includes at least one depression disposed on the inner wall of the block.

In one embodiment, the dual inverse mirror planes further includes two pairs of sub-surfaces, each having an inflexion axis, each of the pairs of sub-surfaces is configured to straddle the inflexion axis. In one embodiment, the pairs of sub-surfaces are coaxially disposed along the inflexion axis of each of the pairs of sub-surfaces.

In one embodiment, each of the pairs of sub-surfaces of the dual inverse mirror planes includes a keyway and a key, each keyway of one of the pairs of sub-surfaces is configured in a shape complementary to the key of the other one of the pairs of sub-surfaces.

In one embodiment, the architectural building block further includes a channel disposed along the inflexion axis of one of the pairs of sub-surfaces configured for accommodating rebars, steel cables, Kevlar®, carbon fiber or any tensile elements.

In one embodiment, the dihedral angle formed of each pair of blocks ranges from about 1 degree to about 12 degrees.

The architectural building block may be constructed from concrete, cinders, vitrified ceramic, glass, plastic, wood pulp, cardboard, fiberglass, epoxy composite, metal, construction foam, tamped earth, boron, borides, or any combinations thereof.

In one embodiment, each side wall further includes a channel connecting the outer wall and the inner wall, where the channel is configured for accommodating rebars, steel, Kevlar® or carbon fiber cables or any tensile elements.

An object of the present invention is to provide a block capable of assembly with similar blocks to form spheres and spherical domes.

Another object of the present invention is to provide a block capable for use with one or more tensile elements that run in a plane substantially parallel to the outer or inner wall.

Another object of the present invention is to provide a block capable for use with one or more tensile elements that run in a plane substantially normal to the outer or inner wall.

Another object of the present invention is to provide a block capable of assembly with similar blocks with or without mortar.

Another object of the present invention is to provide a block capable of assembly with similar blocks with interlocking features.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1 is a top front perspective view of a block.

FIG. 2 is a top plan view of the block thereof.

PARTS LIST

Figure 3:
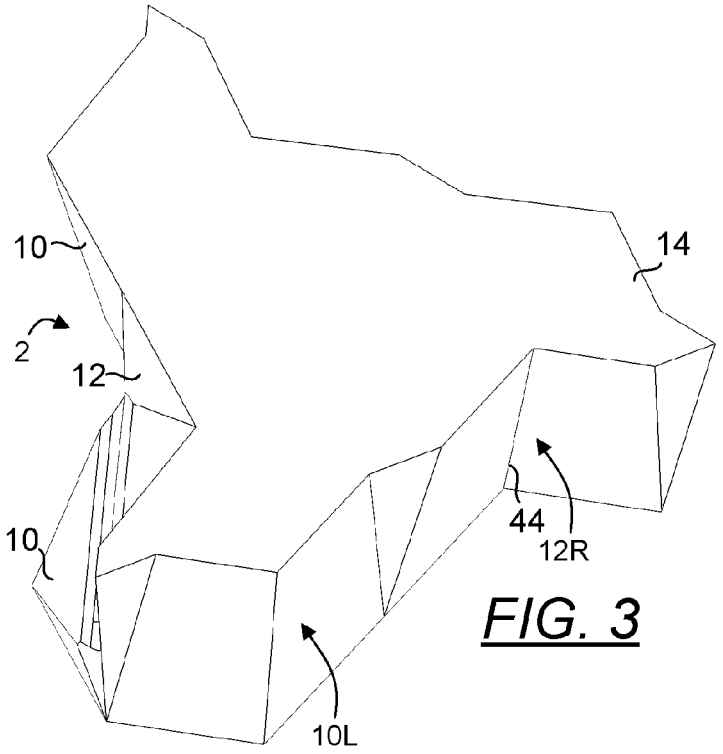
FIG. 3 is a top right side perspective view of the block thereof.
Figure 4:
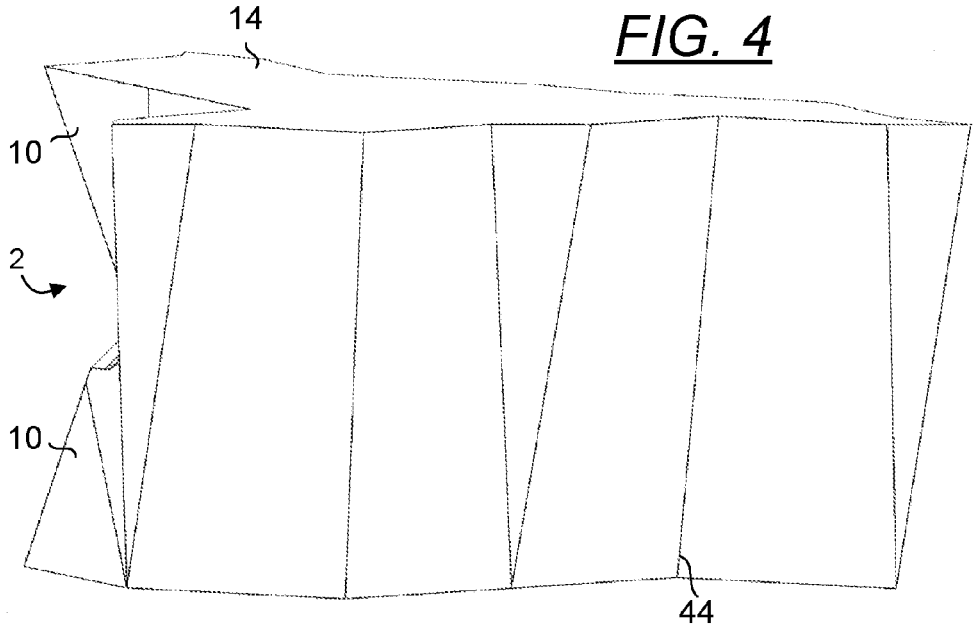
FIG. 4 is another top right side perspective view of the block thereof.
Figure 5:
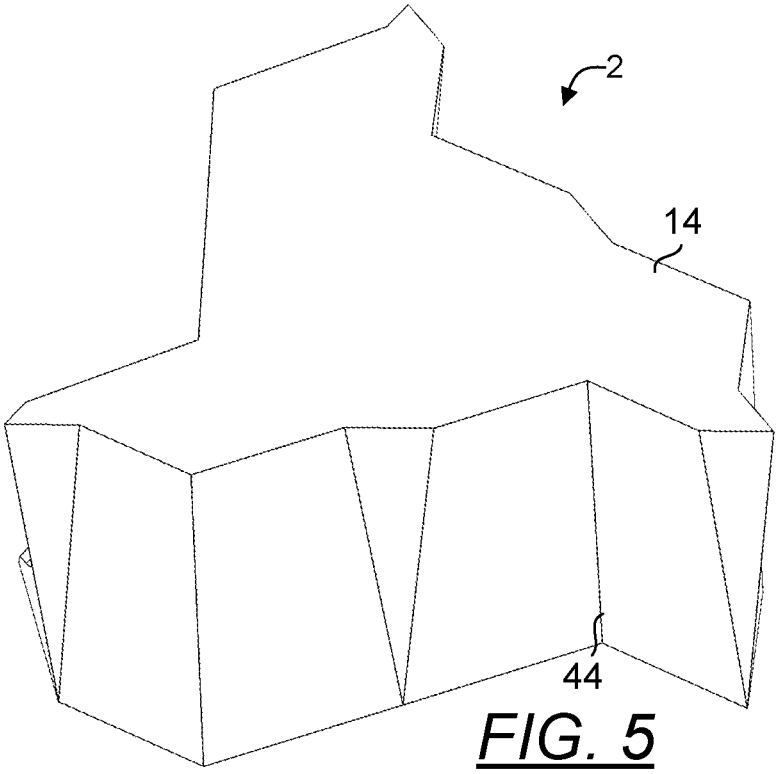
FIG. 5 is a top right side rear perspective view of the block thereof.

2—architectural building block
4—side wall with single inverse mirror plane or SIMP wall
6—side wall with dual inverse mirror planes or DIMP wall
8—horizontal rebar or tensile element channel
10—protrusion or key
12—depression or keyway
14—outer wall
16—inner wall
18—pallet
20—length of DIMP wall
21—length of SIMP wall
22—block former or core puller
24—direction of movement of block former or core puller
26—draw length of block former or core puller
28—single inverse mirror plane or SIMP
30—dual inverse mirror planes or DIMP
32—dihedral angle
34—rebar or tensile element
36—mortar or gasket
38—angle made between side walls of two coupled blocks
40—inflexion axis
42—depression on inner wall
44—rebar or tensile element channel
46—hexagonal group of blocks
48—pentagonal group of blocks

PARTICULAR ADVANTAGES OF THE INVENTION

A plurality of the present blocks can be used not only to build flat surfaces, but also spheres and spherical domes, etc. As such, this provides design flexibility in the types of structures that may result from the use of such blocks or the types of structures that result from the use of only rectangular blocks.

Structures, e.g., spheres and spherical domes, that are formed as a result of the use of the present blocks include interlocking portions and can include tensile elements, e.g., rebars, resulting in greater flexural rigidity and overall strength in the structures. Such structures present greater resistance to external loading, impacts, high winds, seismic forces, etc.

Each present block includes a horizontal channel 8 disposed on only one engaging surface. When a plurality of present blocks are assembled in a pentagonal or hexagonal shape to form a basic unit, a tensile element, e.g., rebar, can be applied collectively to the basic unit to surround the basic unit. Interlocking of side walls of the plurality of present blocks within the basic unit may be sufficient to keep the plurality of blocks within the basic unit together while bounded by the applied tensile element, e.g., rebar, around the periphery of the basic unit. As such, a plurality of present blocks may be pre-assembled in a staging area before a basic unit that is formed from the plurality of blocks are moved to position and installed in place, thereby removing the need to painstakingly install one block at a time. This also removes the more tedious and time-consuming work of adjusting and readjusting the fit of each block individually. In cases where further strengthening of a structure constructed from the present blocks, tensile elements, e.g., rebars can be used within each basic unit, regardless of the order or frequency of the basic unit. No continuous tensile elements, e.g., rebars, are required to hold all or most blocks together as the blocks are interlocked, simplifying and speeding up installation of present blocks to form structures. A continuous tensile element, e.g., rebar, is only used for a basic unit of a pentagonal or hexagonal group, where the number of blocks contained in such a group is a function of the order or frequency of the group. Tensile elements, e.g., rebars may also be installed in-situ during installation of individual blocks.

Mortar or gasket materials may be used to fill the gaps between blocks or to adjust the dihedral angle of each pair of blocks. As the keys are configured to be coupled with keyways on each side wall, the installation or addition of a block into already installed blocks can be made effortlessly even when mortar is required, removing guesswork and trial and error. The ability to form a structure which can readily receive mortar makes the application of mortar easier and faster as mortar may also be sprayed on the structure without concerns of the proper spacing of blocks using mortar and ability of mortar in holding two blocks together. Mortar may also be applied individually on each block while it is being added one-at-a time to an assembly.

A plurality of present blocks can be formed at once on each pallet of a conventional block manufacturing machine, making the process of forming such blocks as economically feasible as those of ubiquitous rectangular blocks. Further, in one embodiment, the present blocks are dimensioned to correspond to the modular coordination of design used in U.S. construction, where all materials are based on 4 inch cubic grid. In one embodiment, each present block measures about 16 inches (side wall length 20 of FIG. 11) by about 16 inches (side wall length 21 of FIG. 11) by about 16 inches (side wall length 21 of FIG. 11) by about 8 inches (side wall height), i.e., dimensions that are similar to the ubiquitous concrete blocks used in the U.S. construction industry. These dimensions allow for a maximum number of blocks to be made per cycle on an existing block machine; a feature which is very important to mold life and throughput for a block manufacturer. This high throughput results in low cost and high performance structures.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 6:
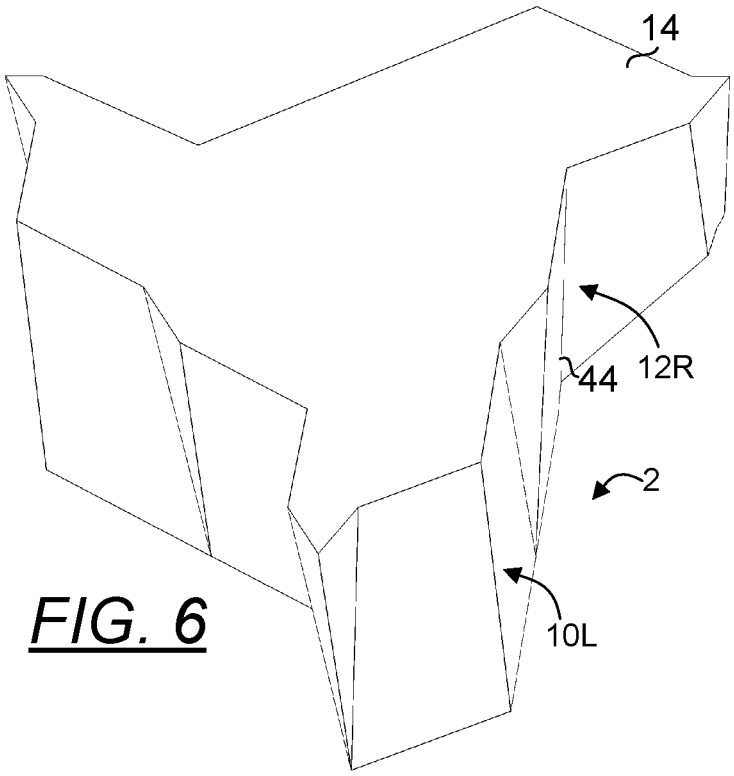
FIG. 6 is a top rear perspective view of the block thereof.
Figure 7:
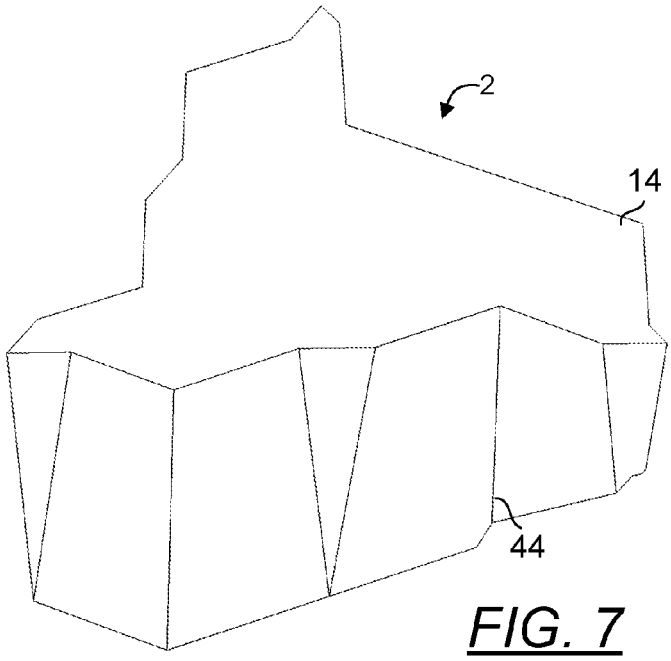
FIG. 7 is a top left side rear perspective view of the block thereof.
Figure 8:
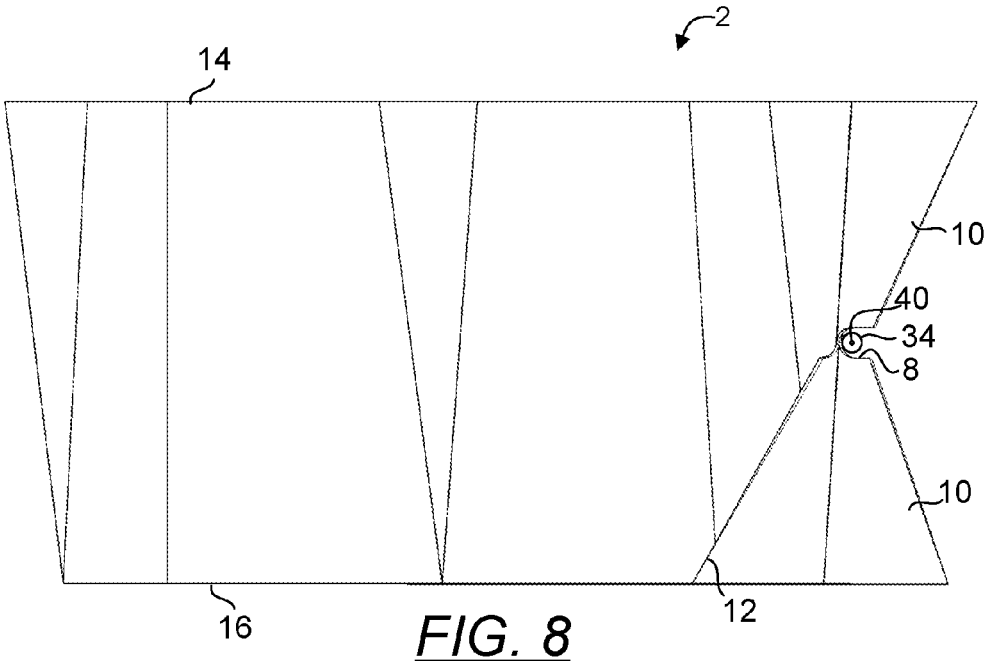
FIG. 8 is a left side view of the block thereof.
Figure 9:
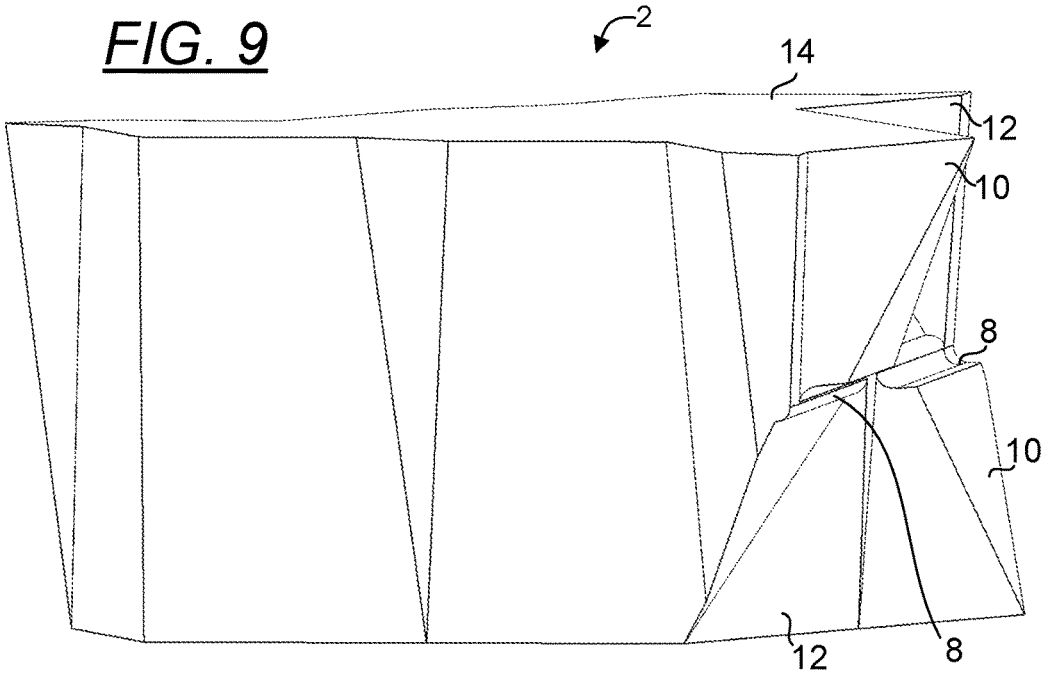
FIG. 9 is a top left side front perspective view of the block thereof.
Figure 10:
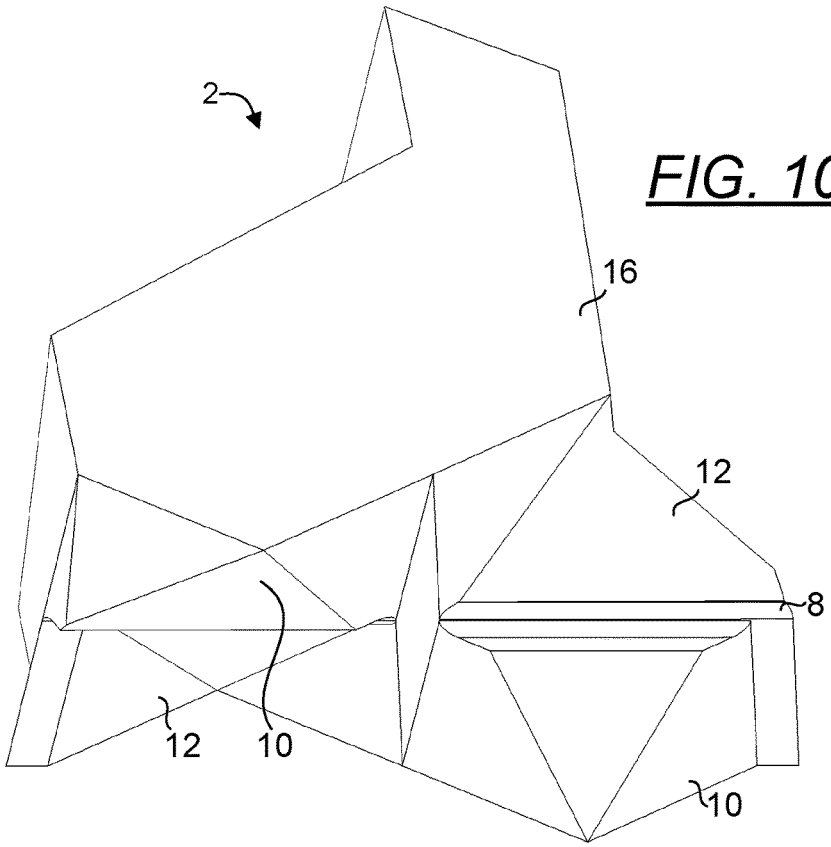
FIG. 10 is a bottom perspective of the block thereof.
Figure 11:
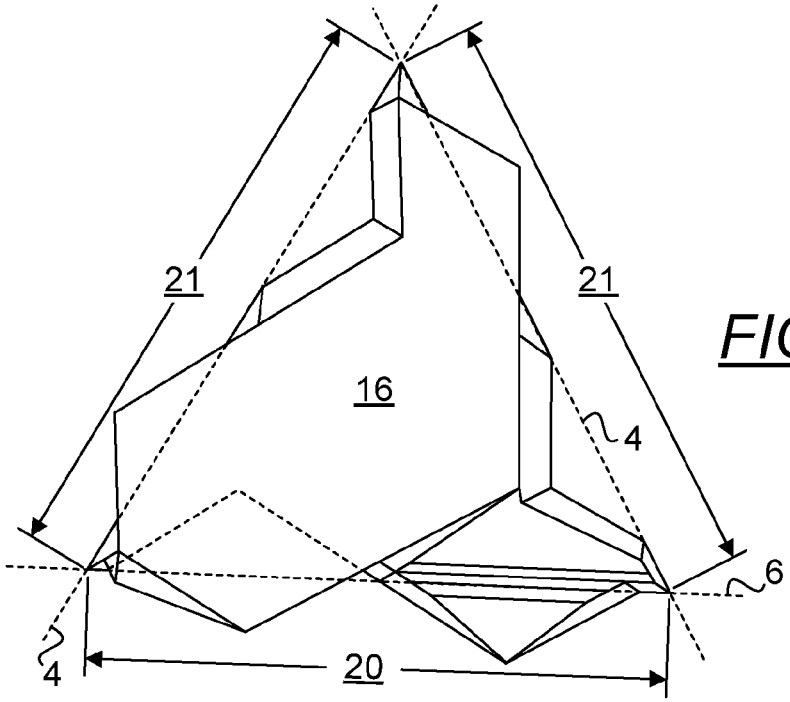
FIG. 11 is a bottom plan view of the block thereof.
Figure 12:
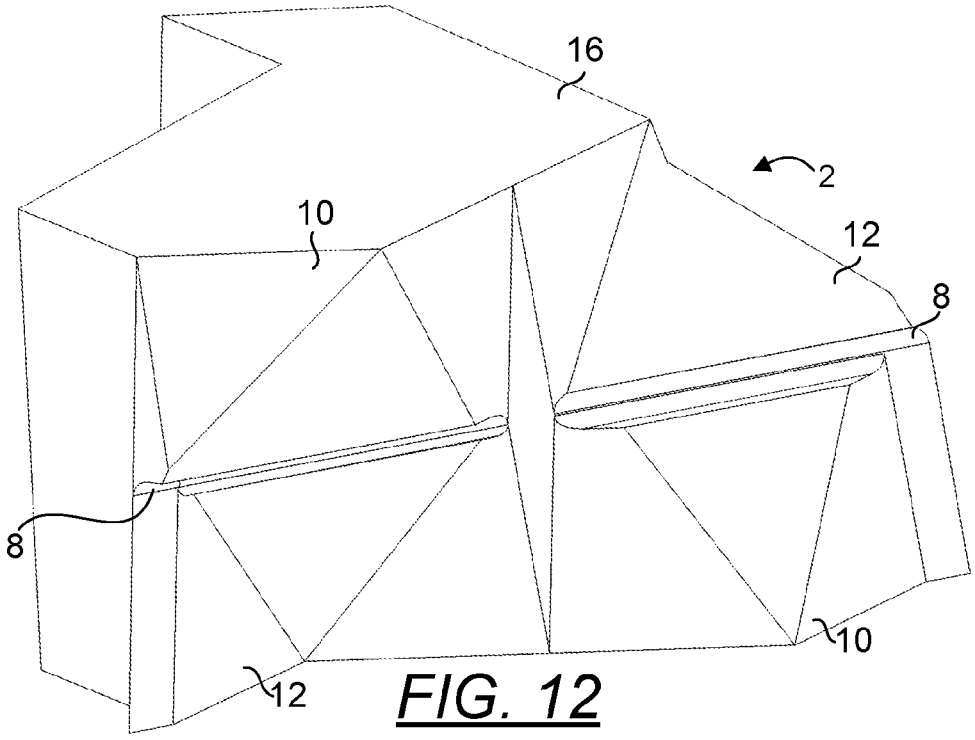
FIG. 12 is a bottom front perspective view of the block thereof.
Figure 13:
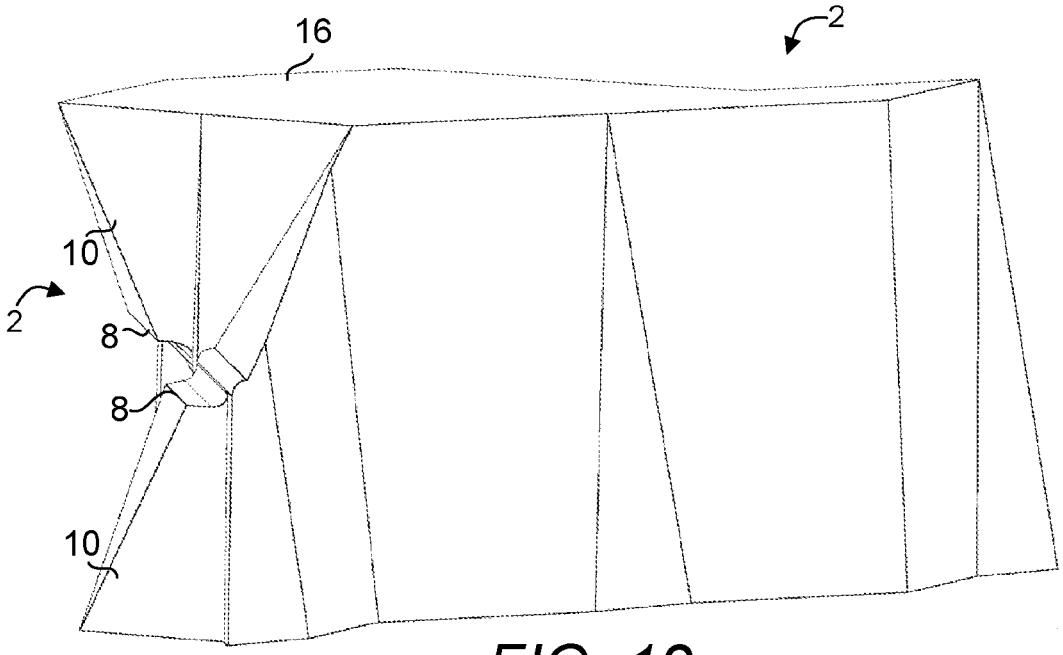
FIG. 13 is a bottom right side perspective view of the block thereof.
Figure 14:
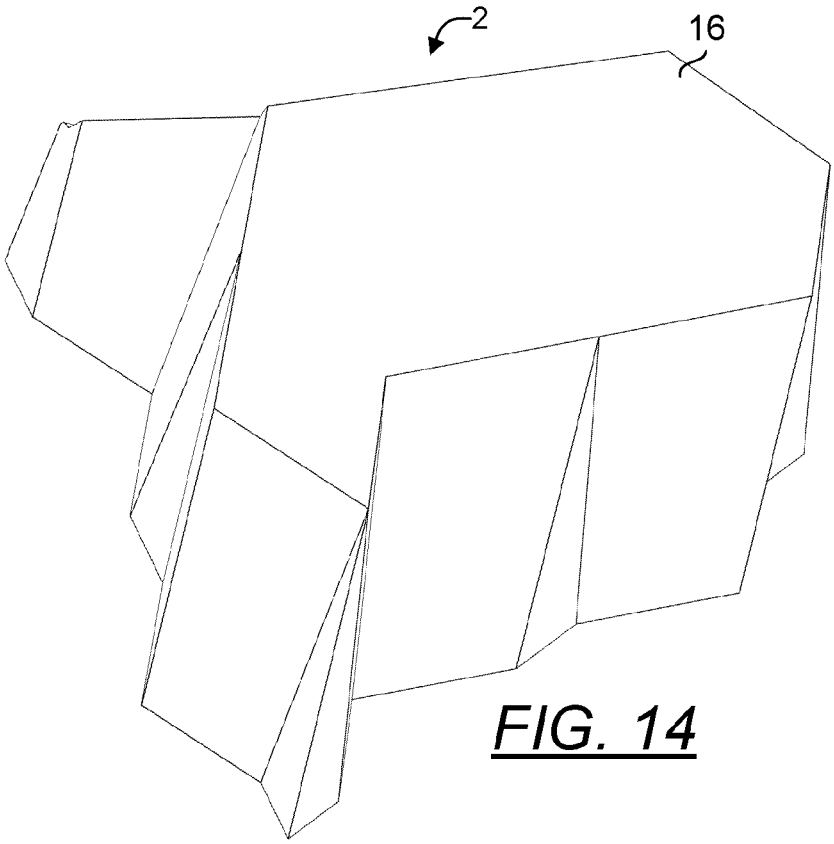
FIG. 14 is a bottom left side perspective view of the block thereof.

Disclosed herein are embodiments of an architectural building block for construction of spheres or spherical domes. FIGS. 1-15 disclose an embodiment of the present block individually. A present architectural building block 2 is a generally triangular block having an outer wall 14, an inner wall 16 disposed in substantially parallel configuration with respect to the outer wall 14 and three side walls, each adjoining the outer wall 14 and the inner wall 16. One of the side walls includes dual inverse mirror planes (DIMP) and each of the other two of side walls includes a single inverse mirror plane (SIMP). For sake of brevity, a side wall having a SIMP will be referred to as a SIMP wall 4 and a side wall having a DIMP will be referred to as a DIMP wall 6 herein, respectively. For ease of describing the side walls and as shown in FIGS. 1 and 2, dotted lines are used to represent the top edges of side walls. A dotted line labelled by part number '4' represents a top edge of a SIMP wall 4. A dotted line labelled by part number "6" represents a top edge of a DIMP wall. A SIMP wall 4 is then represented by a plane which extends downwardly from a dotted line labelled "4" along wall portions of the SIMP wall 4 that coincide with the dotted line labelled "4." In a similar manner, a DIMP wall 6 is then represented by a plane which extends downwardly from a dotted line labelled "6" along wall portions of the DIMP wall 6 that coincide with the dotted line labelled "6." In one embodiment as shown in FIGS. 1-15, the DIMP includes two pairs of sub-surfaces, each having an inflexion axis 40. Each of the pairs of sub-surfaces is configured to straddle the inflexion axis 40. In the embodiment shown, the pairs of sub-surfaces are coaxially disposed along the inflexion axis 40 of each of the pairs of sub-surfaces. Referring to FIG. 1, each of the pairs of sub-surfaces of the dual inverse mirror planes includes a key 10 and a keyway 12. Each keyway 12 of one of the pairs of sub-surfaces is configured in a shape complementary to the key 10 of the other one of the pairs of sub-surfaces. A block further includes a channel configured for accommodating a rebar or any tensile elements, disposed along the inflexion axis of each of the pairs of sub-surfaces. The channel is preferably cylindrical in shape and suitably sized to accommodate a common construction rebar. However other tensile elements, steel, Kevlar® or carbon fiber cables may also be used. A letter "R" or "L" is used in conjunction with a part number to further specify the side of a wall the part is referenced, where "R" or "L" represents the right side and left side, respectively. For instance, key 10R includes a shape complementary to keyway 12L and key 10L includes a shape complementary to the shape of keyway 12R. Turning our attention now to FIG. 3, it can be seen that the SIMP wall 4 facing the reader includes a key 10L disposed on the left side of the wall and a keyway 12R disposed on the right side of the wall. Key 10L is configured in a shape complementary to the shape of keyway 12R. Similarly, FIG. 6 shows another one of the SIMP walls where, again a key 10L is disposed on the left side of the wall and a keyway 12R is disposed on the right side of the wall. Again, Key 10L is configured in a shape complementary to the shape of keyway 12R. Referring to at least FIGS. 1, 3 and 6, it shall be noted that each side wall of a block 2 includes a rebar or tensile element channel 44 connecting the outer wall 14 and the inner wall 16 of the block 2. Each such channel 44 enables a rebar or another tensile element 34 to traverse the outer wall-inner wall direction and where rebar or another tensile element 34 may be "anchored" to a post, another block in a second wythe of the blocks or any structure erected on the inner wall of the block during installation. The side on which a key is disposed on a side wall can be reversed provided a complementary keyway is provided on the opposite side and that both SIMP walls include a key that is disposed on the same side. For instance, if a key of a first SIMP wall is disposed on the right side of the first SIMP wall, the key of a second SIMP wall must be located on the same side, i.e., the right side of the second SIMP wall. Referring to FIG. 11 and in one embodiment, as measured along the top edge of each wall, the length 21 of a SIMP wall 4 measures about 16 inches and the length 20 of a DIMP wall 6 measures about 16 inches and the height measures about 8 inches. In this embodiment, a spherical dome constructed from blocks having such dimensions may span about 8 ft. in diameter for a first frequency structure, 16 ft. in diameter for a second frequency structure and 24 ft. in diameter for a third frequency structure. The area of the outer wall 14 is configured to be greater than the area of the inner wall 16 such that a structure constructed from a plurality of such blocks can result in a convex outer surface and the blocks can be interlocked under their own weight. Therefore, in general, each side wall of a present block is disposed at an angle that is not right angle to either the outer wall or inner wall and each side wall culminates towards the center of the inner wall. Unlike the pair of sub-surfaces of the DIMP, the key and keyway pair of each SIMP wall are horizontally disposed. Coupled SIMP walls interlock as any potential relative lateral movement is retarded by the coupled keys and keyways and any potential relative vertical (in outer-inner wall direction) movement is retarded by the friction created between the SIMP walls due to the weight of the interlocking blocks). Coupled DIMP walls interlock as any potential relative lateral and vertical movements are retarded by the coupled keys and keyways. In one embodiment not shown, at least one SIMP wall is replaced with a DIMP wall. However, such a block may not be mass-produced using conventional block manufacturing equipment and techniques as an increased number of DIMPs will necessitate an increase in the number of keyways not accessible to vertically disposed "shoe" during manufacturing. In yet another embodiment not shown, all side walls are SIMP walls, although this embodiment is less desirable as the interlocking features of a plurality of such blocks rely heavily on the friction created under the weight of interlocking blocks.

Suitable materials for constructing the present block include, but not limited to, concrete, cinders, vitrified ceramic, glass, plastic, wood pulp, cardboard, fiberglass, epoxy composite, metal, construction foam, tamped earth, boron, borides, and any combinations thereof. The decision to select a material lies in such factors as the manufacturing costs, material costs, ease of construction, availability of materials, ease of use of the resultant blocks, required strength of the resultant blocks, maintenance requirement of the resultant blocks, etc. Care shall also be taken to create blocks with rounded edges or corners as they are often stress concentrators that can inadvertently come in contact with and bear point loads that can eventually lead to pre-mature failures.

Figure 15:
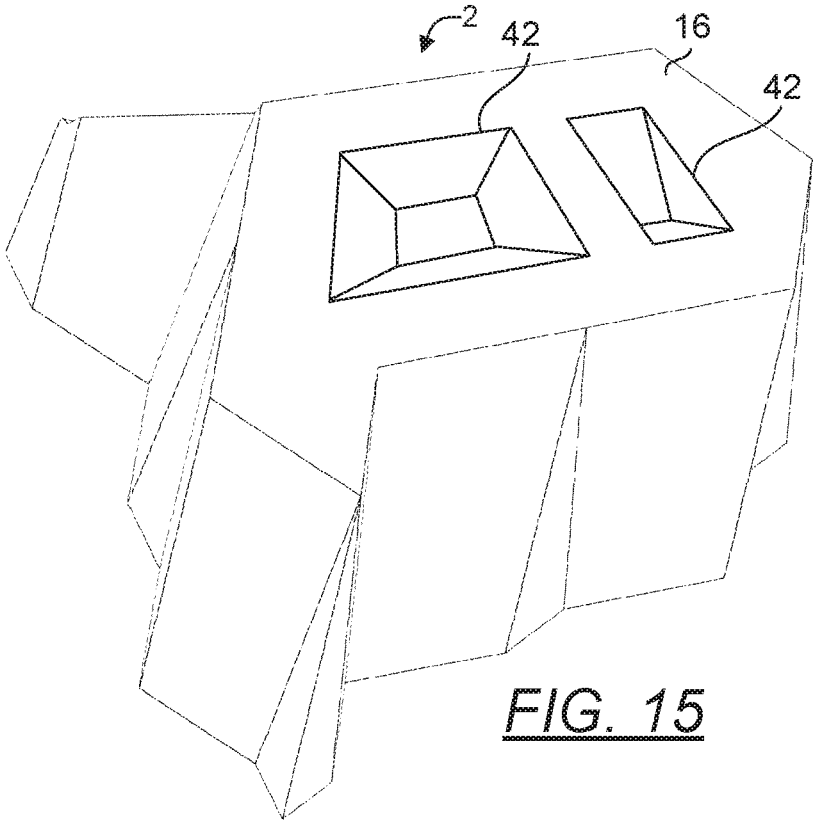
FIG. 15 is a bottom left side perspective view of a block, depicting the use of depressions to reduce the weight of the block and create handhold for masons without affecting the load bearing ability of the block.

FIG. 15 is a bottom left side perspective view of a block, depicting the use of depressions 42 to reduce the weight of the block and the amount of material for constructing the block and create a handhold for masons for more easily pick up the block without affecting the load bearing ability of the block. It can be seen that two depressions 42 are formed on the inner wall 16 where they are separated by a bridge. One continuous depression may also be used provided that forming one large continuous depression does not affect the integrity of the block during forming and the performance of the block upon curing of the block.

Figure 15A:
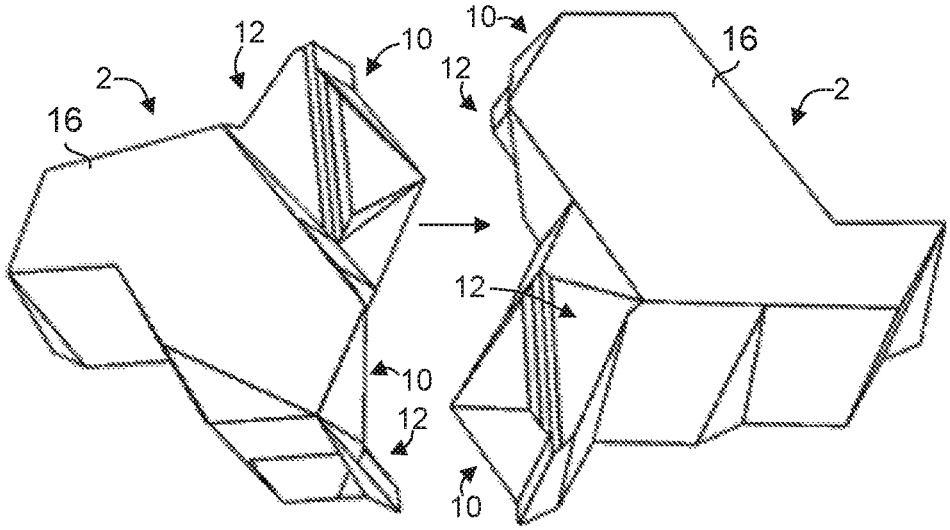
FIG. 15A is a bottom view depicting two blocks arranged to be coupled at their respective wall having dual inverse mirror planes (DIMP).
Figure 15B:
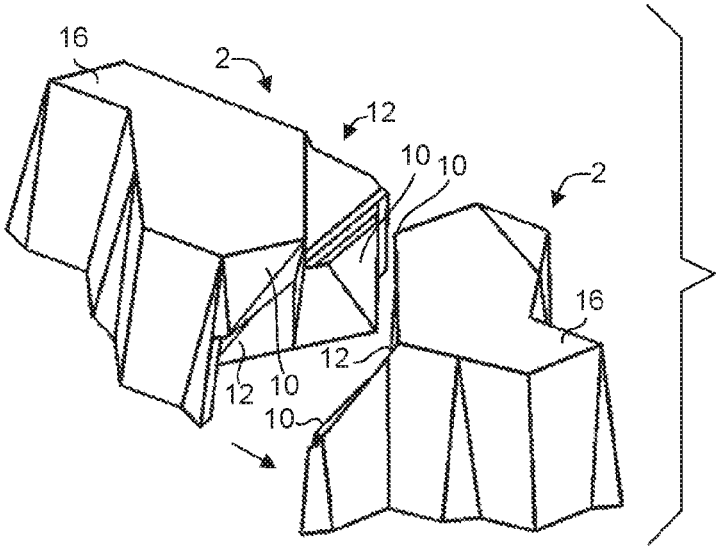
FIG. 15B is a bottom side view depicting two blocks arranged to be coupled at their respective wall having DIMP.
Figure 15C:
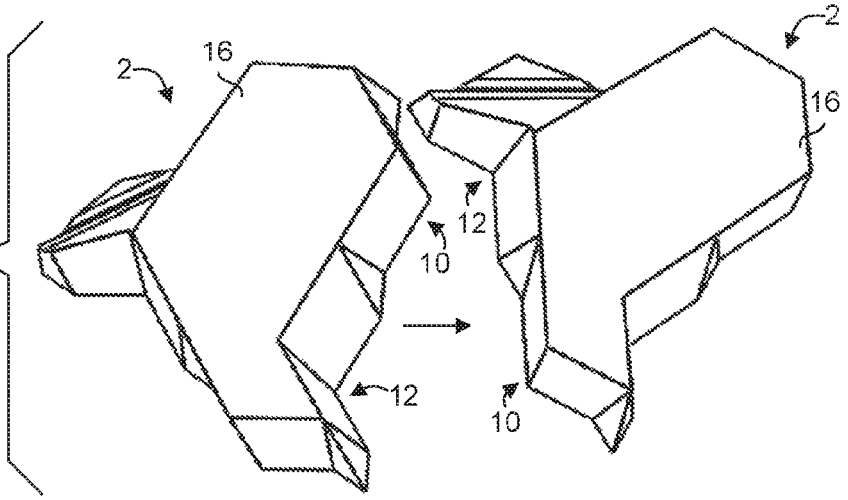
FIG. 15C is a bottom view depicting two blocks arranged to be coupled at their respective wall having a single inverse mirror plane (SIMP).
Figure 15D:
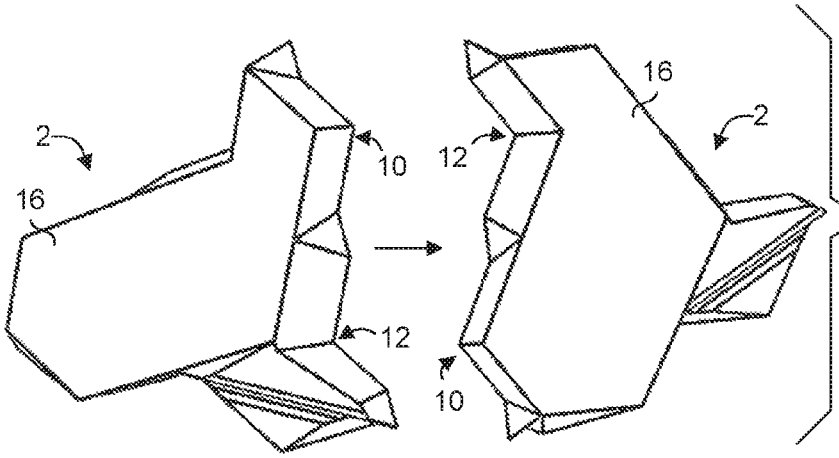
FIG. 15D is a bottom view depicting two blocks arranged to be coupled at their respective wall having a SIMP.

FIGS. 15A-15D depict the manner in which each set of two blocks are coupled to form a larger structure. FIG. 15A is a bottom view depicting two blocks arranged to be coupled at their respective wall having dual inverse mirror planes (DIMP). FIG. 15B is a bottom side view depicting two blocks arranged to be coupled at their respective wall having DIMP. FIG. 15C is a bottom view depicting two blocks arranged to be coupled at their respective wall having a single inverse mirror plane (SIMP). FIG. 15D is a bottom view depicting two blocks arranged to be coupled at their respective wall having a SIMP. It shall be noted that in each of FIGS. 15A-15D that a key 10 of one type of wall (SIMP or DIMP) of one block is matched with a keyway 12 of the same type of wall of another block.

Figure 16:
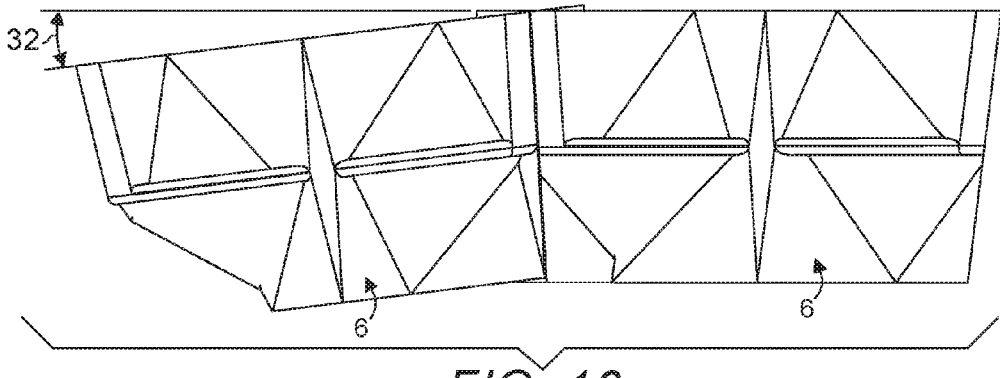
FIG. 16 depicts a combined unit of two blocks, depicting a dihedral angle that is formed as a result of combining the two blocks where no mortar has been applied.
Figure 17:
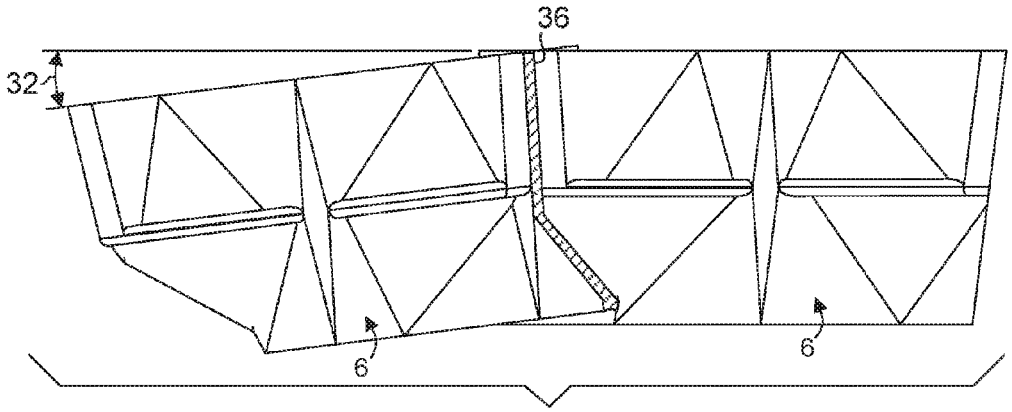
FIG. 17 depicts a combined unit of two blocks, depicting a dihedral angle that is formed as a result of combining the two blocks where mortar has been applied and an angle between blocks has been maintained.
Figure 18:
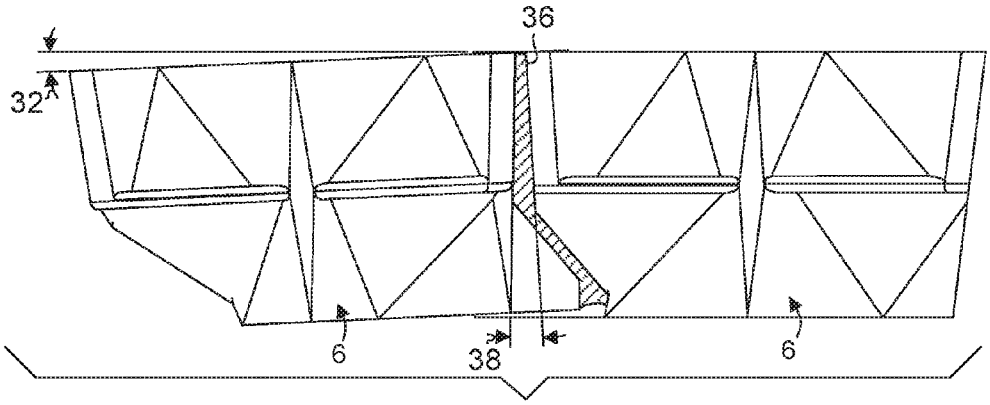
FIG. 18 depicts a combined unit of two blocks, depicting an angle between blocks that is formed as a result of combining the two blocks where mortar has been applied and the angle between blocks has been altered from that shown in FIG. 17.
Figure 19:
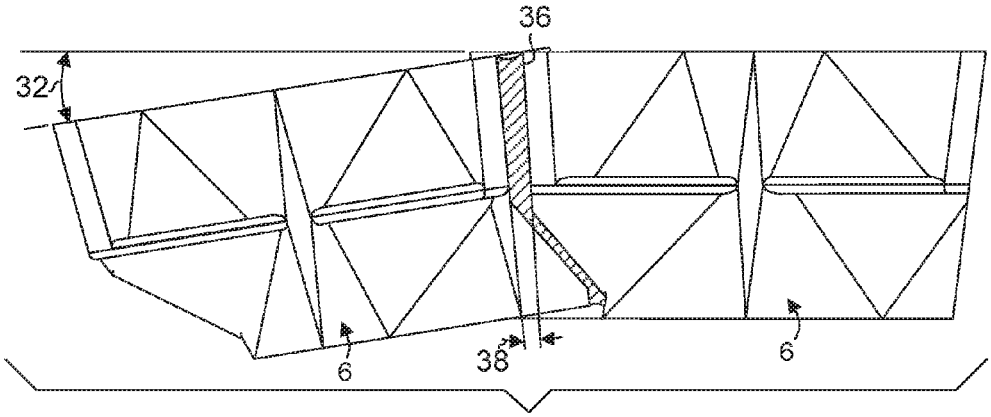
FIG. 19 depicts a combined unit of two blocks, depicting an angle between blocks that is formed as a result of combining the two blocks where mortar has been applied and the angle between blocks has been altered from those shown in FIGS. 17 and 18.

FIGS. 16-19 depict a manner in which each pair of blocks are coupled which forms the foundation of the curve that results from combining a plurality of such blocks to form a curvilinear structure, e.g., a sphere or a spherical dome. Notice that, in this example, the blocks are disposed such that their DIMP walls face the reader and the blocks are arranged such that the left SIMP wall of the right block is aligned with the right SIMP wall of the left block. FIG. 16 depicts a combined unit of two blocks, depicting a dihedral angle 32 that is formed as a result of combining the two blocks. The left SIMP wall of the right block is mated with the right SIMP wall of the left block. No mortar or gasket is shown used to fill the gap between the two blocks in FIG. 16. Suitable dihedral angles range from about 1 degree to about 12 degrees. A higher order or frequency structure generally requires blocks that will result in lower dihedral angles between blocks while a low order or frequency structure generally requires blocks that will result in larger dihedral angles between blocks. The surface curvature per unit area of a structure having a higher order or frequency is therefore generally more severe than the surface curvature per unit area of a structure having a lower order or frequency. In practice and during installation, the angle made between two blocks can also be altered via the application of mortar or gasket. FIG. 17 depicts a combined unit of two blocks, depicting a dihedral angle that is formed as a result of combining the two blocks. In this example, mortar or a gasket 36 is applied to the gap between the two blocks while the dihedral angle formed of the two blocks is maintained. It shall be noted that the gap between the two blocks are maintained throughout the height of the blocks. Therefore, the angle made between the two blocks is the same as the dihedral angle. FIG. 18 depicts a combined unit of two blocks, depicting an angle between blocks that is formed as a result of combining the two blocks where mortar or a gasket 36 has been applied and the angle between blocks has been altered by rotating the left block clockwise and therefore widening the gap between the two blocks with respect to their inner walls and filling the gap with mortar or a gasket forming an angle 38 between the two blocks. FIG. 19 depicts a combined unit of two blocks, depicting an angle between blocks that is formed as a result of combining the two blocks where mortar or a gasket has been applied and the angle between blocks has also been altered. Compared to FIG. 18, angle 38 has been reduced by rotating the left block counterclockwise. It can therefore be seen that the radius of a sphere or spherical dome can be adjusted by adjusting the dihedral angle between each pair of abuttingly placed blocks and/or by adjusting the angle formed between the pair.

Figure 20:
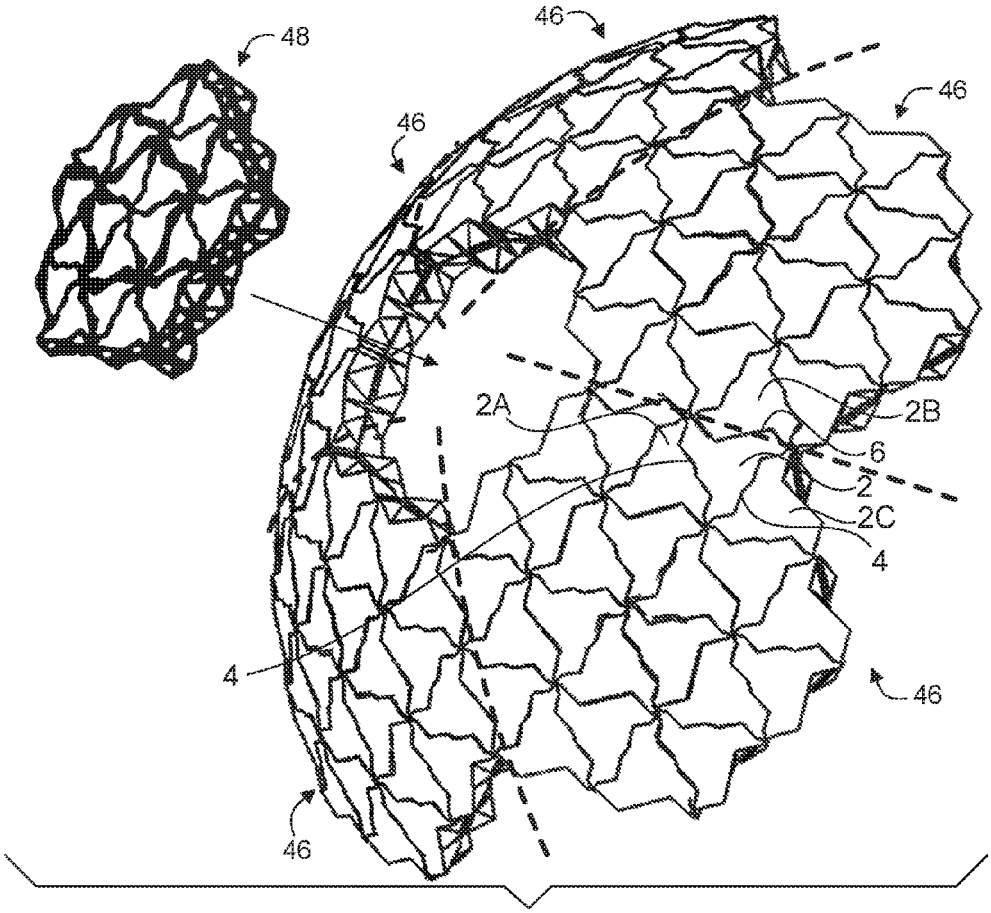
FIG. 20 is a top perspective view of a partial single-wythed spherical dome built with a plurality of present blocks.
Figure 20A:
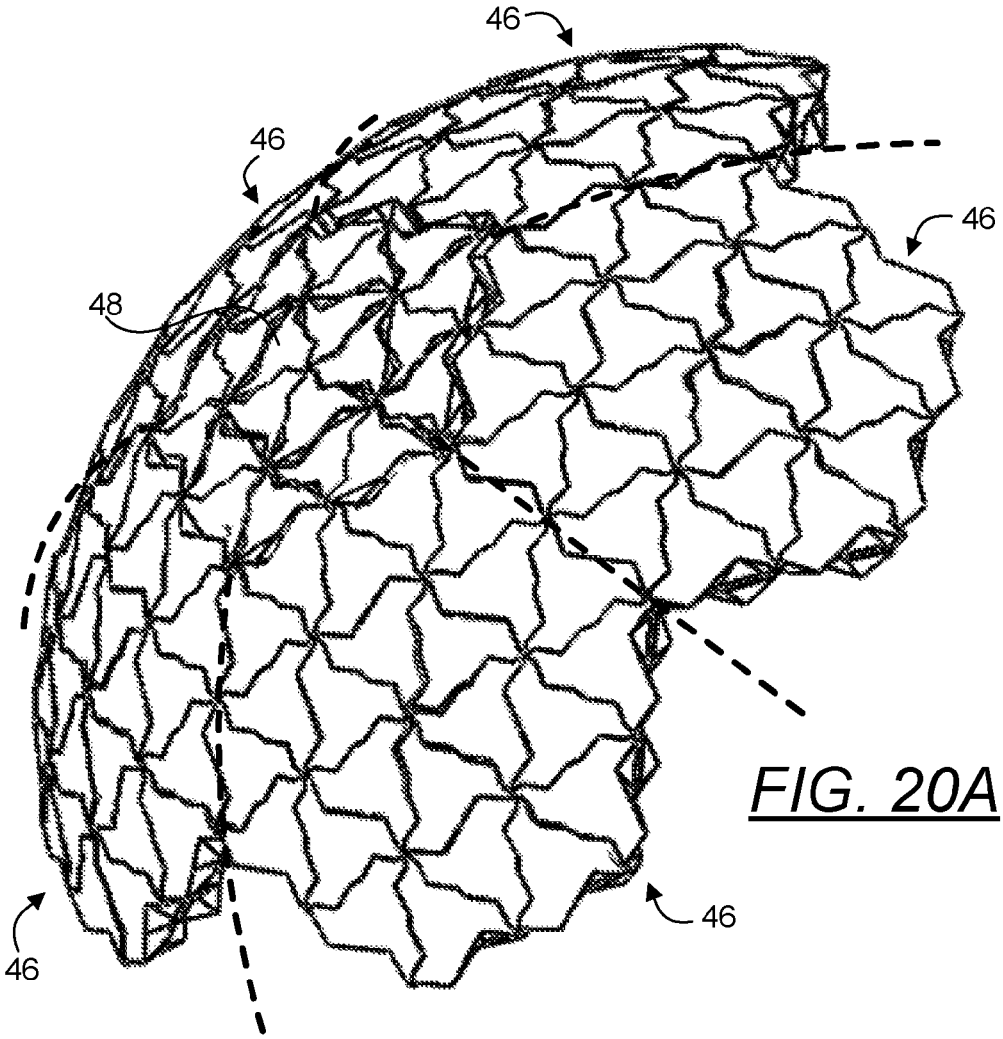
FIG. 20A is a top perspective view of a partial single-wythed spherical dome built with a plurality of present blocks, depicting a pentagonal group of blocks having been installed in the gap shown in FIG. 20.
Figure 21:
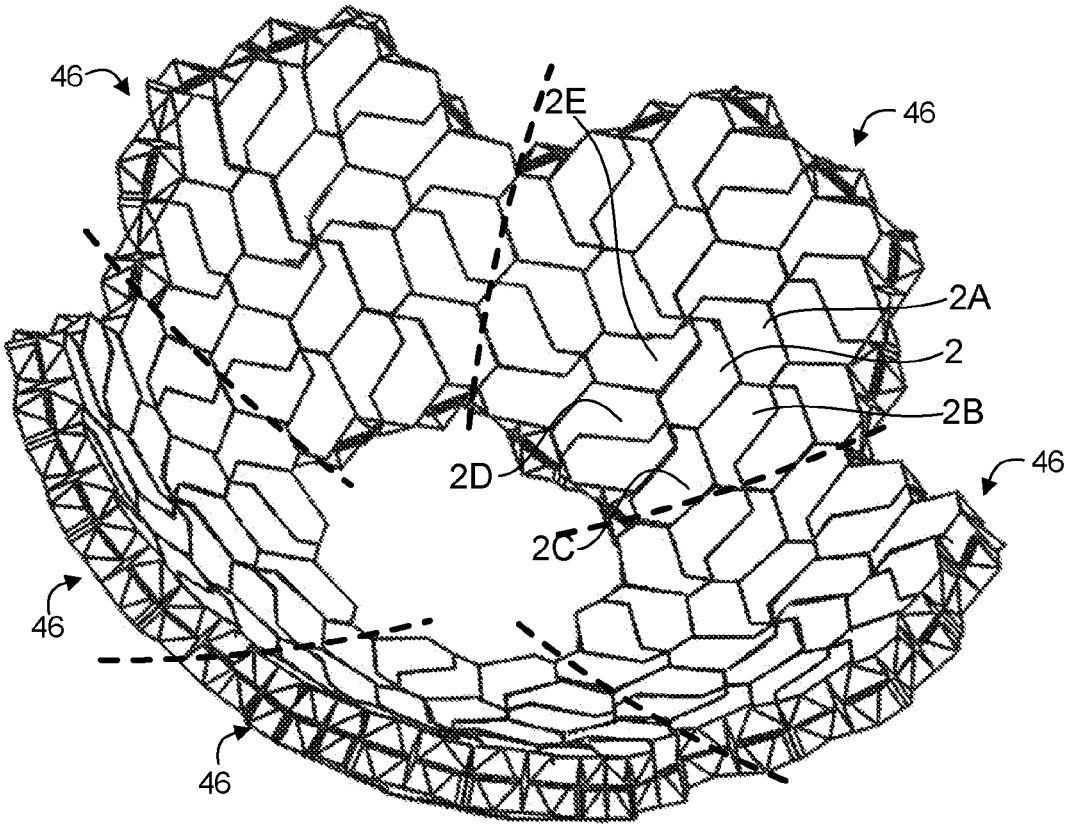
FIG. 21 is a bottom perspective view of the partial single-wythed spherical dome thereof.
Figure 21A:
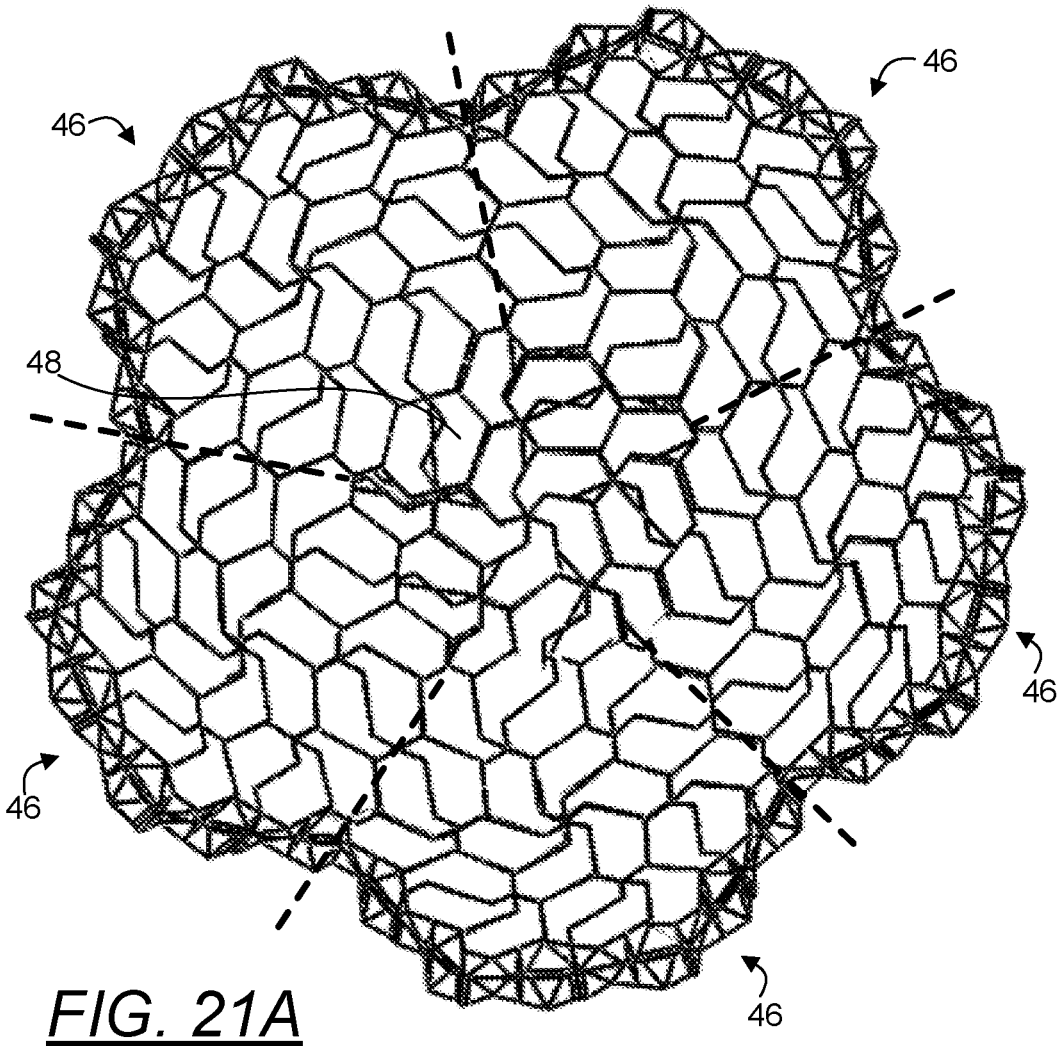
FIG. 21A is a bottom perspective view of a partial single-wythed spherical dome built with a plurality of present blocks, depicting a pentagonal group of blocks having been installed in a gap shown in FIG. 21.

Having described the manner in which a curvature can be formed from a pair of blocks, it is now clear that a plurality of the present blocks may then be used to build a sphere or spherical dome. In the ensuing example, a plurality of present blocks are shown to be assembled in a manner to form a Goldberg polyhedron. A Goldberg polyhedron is a convex polyhedron made from hexagons and pentagons. FIGS. 20-21A depict partial structures constructed using a plurality of present blocks. Dotted lines shown in FIGS. 20-21A are used to delineate the boundaries of hexagonal groups of blocks 46. FIG. 20 is a top perspective view of a partial single-wythed spherical dome built with a plurality of present blocks. FIG. 20A is a top perspective view of a partial single-wythed spherical dome built with a plurality of present blocks, depicting a pentagonal group of blocks 48 having been installed in a gap shown in FIG. 20. FIG. 21 is a bottom perspective view of the partial single-wythed spherical dome thereof. FIG. 21A is a bottom perspective view of a partial single-wythed spherical dome built with a plurality of present blocks, depicting a pentagonal group of blocks 48 having been installed in the gap shown in FIG. 21. Again, a letter "A," "B," "C," "D," or "E" is used in conjunction with a part number to further distinguish an individual but distinct part from other parts having the same part number. When fully engaged, a block 2 is interlocked with and comes in abutting engagement with six other identical blocks 2A, 2B, 2C, 2D and 2E. As viewed from the outer surface of the partial spherical dome, a block 2 appears to come in abutting engagement with only three blocks, i.e., 2A, 2B and 2C. However, when viewed from the inner wall of the partial spherical dome as shown in FIG. 21, it shall be appreciated that there are five blocks surrounding each center block 2, e.g., 2A, 2B, 2C, 2D and 2E. Referring to FIG. 20 and when viewed from the outer surface of the partial spherical dome, it shall be apparent that a first SIMP wall 4 of a first block 2 is configured to be positionable so as to mate with a SIMP wall 4 of an abuttingly disposed second block 2A. A DIMP wall 6 of the first block 2 is configured to be positionable so as to mate with a DIMP wall 6 of an abuttingly disposed third block 2B. A second SIMP wall 4 of the first block 2 is configured to be positionable so as to mate with a SIMP wall 4 of an abuttingly disposed fourth block 2C. Such pattern of engagement of the blocks can be replicated to form an assembled or installed blocks 46 in the shape of a hexagon as shown in FIG. 20. It shall be noted that, with the order or frequency of the hexagonal groups 46 shown in FIG. 21, there is a total of twenty four blocks used for forming each hexagonal group. There is a total of five hexagonal groups of blocks 46, each connected to two other hexagonal groups of blocks 46 to form an opening in the shape of a pentagon. The gap or space can then be sealed with a pentagonal group of blocks 48 built from a total of twenty blocks 2 to result in a configuration shown in FIG. 21A. It shall be noted that the configuration shown in FIGS. 20-21A is a single-wythed configuration. A structure constructed from the present blocks 2 need not be single-wythed as there are constructions where multi-wythed structures are required, e.g., in applications where external loading to the structures is significant, e.g., environmental impacts and stresses encountered in tornadoes, hurricanes, tsunamis, earthquakes and other extreme loading scenarios. An additional wythe may be added either over the outer wythe or under the inner wythe. Spheres or spherical domes of any size can be built with these blocks as construction using blocks is scalable. A spherical dome twice as large as a structure constructed with a single wythe requires walls twice as thick, i.e., another wythe is required to create a wall twice as thick. If an additional wythe is used, a wall three times as thick or a sphere section that is three times larger than the single wythe sphere section can be created. This feature adds to the design flexibility of the present block by allowing structures to any sizes to be built.

Figure 22:
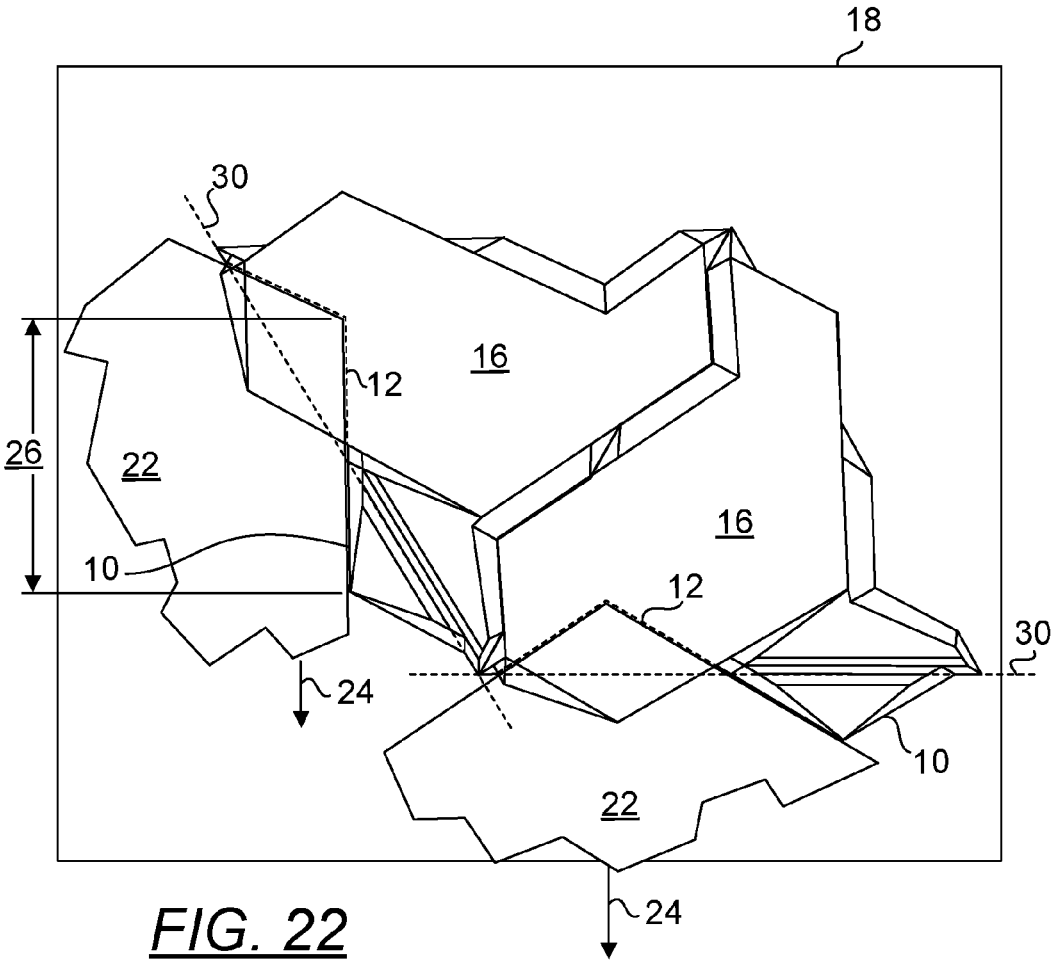
FIG. 22 depicts a top view of an unfavorable configuration during block manufacturing where core pullers may not be correctly retrieved when blocks are being formed.
Figure 23:
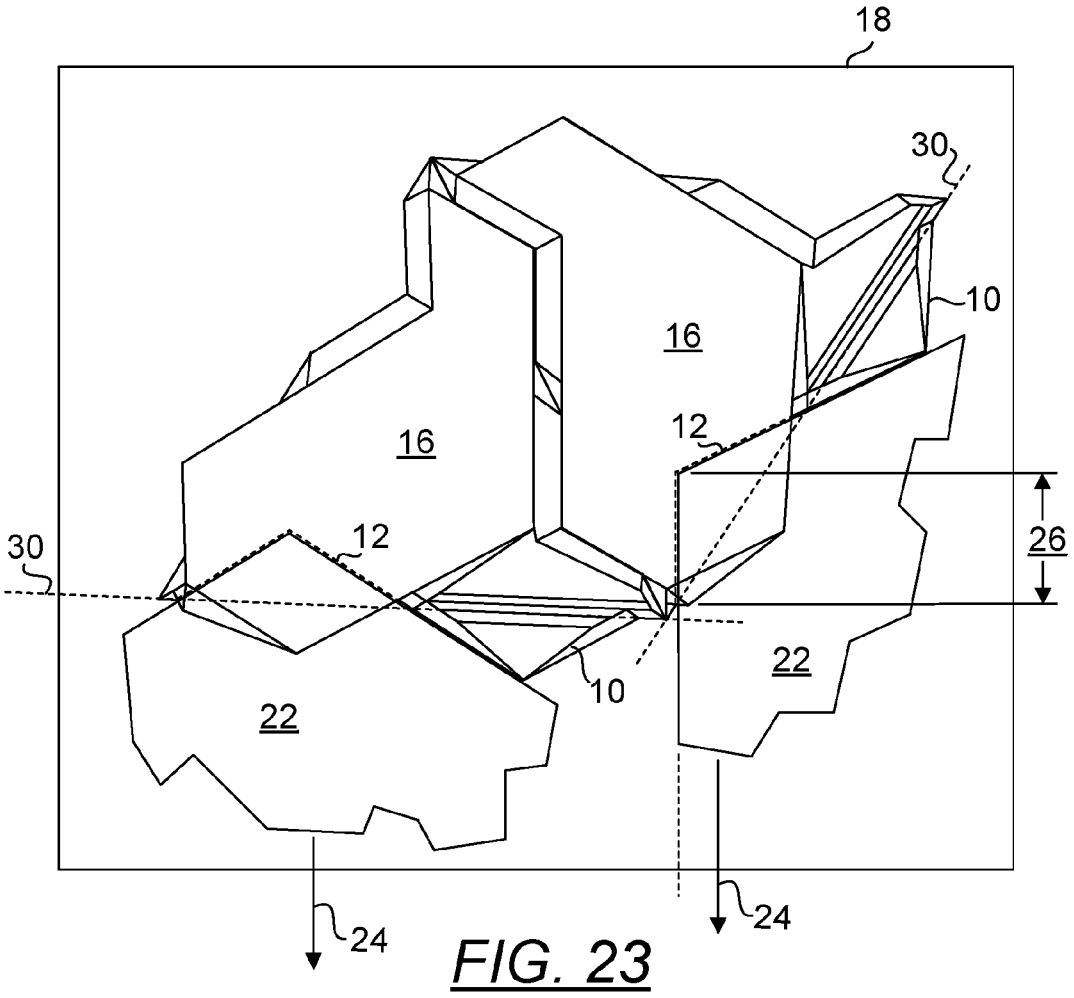
FIG. 23 depicts a top view of a favorable configuration during block manufacturing where core pullers may be correctly retrieved when blocks are being formed, resulting in properly formed blocks.

FIGS. 22-23 depict challenges that are faced in manufacturing present blocks in a conventional block manufacturing practice and the steps taken to overcome such challenges. FIG. 22 depicts a top view of an unfavorable configuration during block manufacturing where core pullers may not be correctly retrieved when blocks are being formed. FIG. 23 depicts a top view of a favorable configuration during block manufacturing where core pullers may be correctly retrieved when blocks are being formed, resulting in properly formed blocks. In a block manufacturing process, it may be critical to be able to form blocks using conventional manufacturing lines as significant investments in manufacturing equipment and processes have already been made to produce other blocks of other types. Materials, e.g., concrete, is an anisotropic material. It has a higher compressive strength in the axis of compaction as blocks are made. In constructing present blocks, raw material is first placed within a mold cavity. A "shoe," configured in the external shape of the present block including such features as depressions, is then applied atop the raw material, compacting and consolidating the raw material, thereby forming a block having a high-strength axis in the direction in which the compacting action is applied. Therefore, structures constructed with present blocks built in this manner will possess strength to resist forces applied normal to the outer or inner walls of the structures. Conventional rectangular concrete blocks are assembled in a wall with the high-strength axis oriented in the vertical direction. As the lower strength axis is oriented horizontally, i.e., the direction in which environmental forces are most prevalent, the resulting structure is weaker and prone to failure from horizontal impacts and stresses such as those encountered in tornadoes, hurricanes, tsunamis, earthquakes and other extreme loading scenarios. Conversely, the present blocks are used for constructing structures that result in a manner where the high-strength axis of each block is oriented in the direction substantially normal to the outer or inner walls of the structures. It shall be noted that, as depicted in FIGS. 22-23, two blocks are formed simultaneously on each pallet and the blocks are formed upside-down, i.e., the inner walls 16 are formed with the "shoe." As such, any depressions required of the inner walls 16 can be readily formed. It shall be noted that in this configuration, however, that the keyway 12 of each block being formed is not accessible to the "shoe" which is configured to move only in the up-down direction, i.e., a direction normal to the top surface of the pallet 18. Therefore, one or more core pullers 22 are required to form keyways not accessible to the "shoe." Core pullers 22 are configured to move in a direction 24 parallel to the movement of the pallet 18 on a conveying system. In the orientation of blocks shown in FIG. 22, in forming the keyway 12 of the left block, there exists a draw length 26 that is excessively large and one which may cause the left block that is being formed to be damaged while the core puller is being retracted in the direction of travel of the pallet. The orientation of blocks that is more conducive to proper block forming is depicted in FIG. 23. In this orientation, the right block is now the block having a more severe draw length 26 as compared to the left block. Compared to the draw length 26 of the left block shown in FIG. 22, there exist less contact area between the right core puller 22 and the right block of FIG. 23 to potentially cause damage to the right block when the right core puller 22 is being retracted.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An architectural building block comprising a generally triangular block having an outer wall, an inner wall disposed in substantially parallel configuration with respect to said outer wall and three side walls, said outer wall having an outer wall area and said inner wall having an inner wall area, each side wall adjoining said outer wall and said inner wall, two of said side walls comprising a single inverse mirror plane disposed on each of said two of said side walls and each of said side walls further comprises a channel connecting said outer wall and said inner wall, said channel is configured for accommodating a tensile element, wherein at least one said side wall is configured to be positionable so as to mate with a side wall of an adjacently disposed block, whereby a curved structure may be constructed as a result of coupling a plurality of blocks identical to said architectural building block on said side walls to form a dihedral angle between each set of two blocks of said plurality of blocks identical to said architectural building block.

2. The architectural building block of claim 1, wherein a third side wall of said side walls comprises dual inverse mirror planes disposed on said third side wall of said side walls.

3. The architectural building block of claim 1, wherein the outer wall area is greater than the inner wall area.

4. The architectural building block of claim 1, wherein said inner wall further comprises at least one depression.

5. An architectural building block comprising a generally triangular block having an outer wall, an inner wall disposed in substantially parallel configuration with respect to said outer wall and three side walls, said outer wall having an outer wall area and said inner wall having an inner wall area, each side wall adjoining said outer wall and said inner wall, one of said side walls comprising dual inverse mirror planes disposed on said one of said side walls and said dual inverse mirror planes further comprise two pairs of sub-surfaces, each having an inflexion axis, each of said pairs of sub-surfaces is configured to straddle said inflexion axis and said architectural building block further comprises a channel disposed along said inflexion axis of one of said pairs of sub-surfaces, said channel is configured for accommodating a tensile element, wherein at least one said side wall is configured to be positionable so as to mate with a side wall of an adjacently disposed block, whereby a curved structure may be constructed as a result of coupling a plurality of blocks identical to said architectural building block on said side walls to form a dihedral angle between each set of two blocks of said plurality of blocks identical to said architectural building block.

6. The architectural building block of claim 5, wherein each of the other two of said side walls comprises a single inverse mirror plane disposed on said each of the other two of said side walls.

7. The architectural building block of claim 5, wherein the outer wall area is greater than the inner wall area.

8. The architectural building block of claim 5, wherein said inner wall further comprises at least one depression.

9. The architectural building block of claim 5, wherein said pairs of sub-surfaces are coaxially disposed along said inflexion axis of said each pair of sub-surfaces.

10. The architectural building block of claim 5, wherein each of said pairs of sub-surfaces of said dual inverse mirror planes comprises a keyway and a key, each keyway of one of said pairs of sub-surfaces is configured in a shape complementary to said key of the other one of said pairs of sub-surfaces such that when the keyway of one block may be mated with the key of an adjacently disposed block.

11. The architectural building block of claim 5, wherein each of said pairs of sub-surfaces of said dual inverse mirror planes comprises a keyway and a key.

12. The architectural building block of claim 5, wherein said dihedral angle ranges from about 1 degree to about 12 degrees.

13. An architectural building block comprising a generally triangular block having an outer wall, an inner wall disposed in substantially parallel configuration with respect to said outer wall and three side walls, each side wall adjoining said outer wall and said inner wall, one of said side walls comprising dual inverse mirror planes disposed on said one of said side walls and each of the other two of said side walls comprises a single inverse mirror plane disposed on said each of the other two of said side walls and said dual inverse mirror planes further comprise two pairs of sub-surfaces, each having an inflexion axis, each of said pairs of sub-surfaces is configured to straddle said inflexion axis and said architectural building block further comprises a channel disposed along said inflexion axis of one of said pairs of sub-surfaces, said channel is configured for accommodating a tensile element, wherein at least one said side wall is configured to be positionable so as to mate with a side wall of an adjacently disposed block, whereby a curved structure may be constructed as a result of coupling a plurality of blocks identical to said architectural building block on said side walls to form a dihedral angle between each set of two blocks of said plurality of blocks identical to said architectural building block of from about 1 degree to about 12 degrees.

14. The architectural building block of claim 13, wherein said pairs of sub-surfaces are coaxially disposed along said inflexion axis of said each pair of sub-surfaces.

15. The architectural building block of claim 13, wherein each of said pairs of sub-surfaces of said dual inverse mirror planes comprises a keyway and a key, each keyway of one of said pairs of sub-surfaces is configured in a shape complementary to said key of the other one of said pairs of sub-surfaces such that when the keyway of one block may be mated with the key of an adjacently disposed block.

* * * * *